US011679322B2

(12) United States Patent
Bovino et al.

(10) Patent No.: US 11,679,322 B2
(45) Date of Patent: Jun. 20, 2023

(54) INTERACTION OF AUDIO, VIDEO, EFFECTS AND ARCHITECTURAL LIGHTING WITH BOWLING SCORING SYSTEM AND METHODS OF USE

(71) Applicant: DFX: Sound Vision, West Berlin, NJ (US)

(72) Inventors: Michael Bovino, Cherry Hill, NJ (US); Andrew Juliano, Hammonton, NJ (US); Gennaro Esposito, Marlton, NJ (US)

(73) Assignee: DFX: SOUND VISION, West Berlin, NJ (US)

( * ) Notice: Subject to any disclaimer, the term of this patent is extended or adjusted under 35 U.S.C. 154(b) by 0 days.

(21) Appl. No.: 17/495,403

(22) Filed: Oct. 6, 2021

(65) Prior Publication Data

US 2022/0088469 A1 Mar. 24, 2022

Related U.S. Application Data

(63) Continuation-in-part of application No. 14/257,301, filed on Apr. 21, 2014, now abandoned.

(51) Int. Cl.
*A63D 5/04* (2006.01)
*A63B 71/06* (2006.01)

(52) U.S. Cl.
CPC ..... *A63D 5/04* (2013.01); *A63B 71/0622* (2013.01); *A63B 2071/0625* (2013.01)

(58) Field of Classification Search
CPC ..... A63D 5/04; A63B 71/0622; A63B 2071/0625
See application file for complete search history.

(56) References Cited

U.S. PATENT DOCUMENTS

| | | | |
|---|---|---|---|
| 4,339,129 | A | 7/1982 | Gautraud |
| 5,071,127 | A | 12/1991 | Bromley et al. |
| 5,450,318 | A | 9/1995 | Mowers et al. |
| 5,489,241 | A | 2/1996 | Perrier |
| 5,800,274 | A | 9/1998 | Widrick et al. |
| 5,846,138 | A | 12/1998 | Borden et al. |

(Continued)

FOREIGN PATENT DOCUMENTS

| | | | |
|---|---|---|---|
| JP | H05192431 | A | 8/1993 |
| JP | 2007014511 | A | 1/2007 |
| KR | 101949474 | B1 | 2/2019 |

OTHER PUBLICATIONS

International Search Report and Wntten Opinion dated Jan. 27, 2023 issued in International Application No. PCT/US/2022/077685 (11 pages).

*Primary Examiner* — Werner G Garner
(74) *Attorney, Agent, or Firm* — Fox Rothschild LLP

(57) ABSTRACT

An interactive bowling system using scoring systems and/or other computer infrastructures which interact with visual and/or audio effects within the bowling center. The system includes a management system having stored therein instructions to provide special effects associated with one or more events to one or more special effects components. Upon an occurrence of an event, the management system: determines that the occurrence of the event is associated with one or more special effects; and provides the instructions to the one or more special effects components to effectuate the special effects associated with the one or more events.

20 Claims, 9 Drawing Sheets

(56) References Cited

U.S. PATENT DOCUMENTS

| | | | | |
|---|---|---|---|---|
| 5,882,263 | A | 3/1999 | Chung | |
| 6,031,343 | A | 2/2000 | Recknagel et al. | |
| 6,270,421 | B1 | 8/2001 | Tsujita | |
| 6,580,954 | B1 | 6/2003 | Shea | |
| 6,712,713 | B1 | 3/2004 | Lundgren | |
| 6,801,003 | B2 | 10/2004 | Schanberger et al. | |
| 7,025,687 | B2 | 4/2006 | Bouchard | |
| 7,202,613 | B2 | 4/2007 | Morgan et al. | |
| 7,264,552 | B2 | 9/2007 | Chen | |
| 7,495,671 | B2 | 2/2009 | Chemel et al. | |
| 7,550,935 | B2 | 6/2009 | Lys et al. | |
| 7,598,684 | B2 | 10/2009 | Lys et al. | |
| 8,292,733 | B2 | 10/2012 | Crawford et al. | |
| 8,641,545 | B2 | 2/2014 | Meigs et al. | |
| 2010/0201491 | A1* | 8/2010 | Jacot | G06Q 10/087 340/10.1 |
| 2011/0053688 | A1 | 3/2011 | Crawford et al. | |
| 2013/0324272 | A1* | 12/2013 | Vaioli | A63D 5/04 473/54 |
| 2015/0124087 | A1 | 5/2015 | Jones, Jr. et al. | |
| 2015/0227870 | A1 | 8/2015 | Noboa et al. | |
| 2015/0297976 | A1 | 10/2015 | Bovino | |

* cited by examiner

INTERACTION OF AUDIO, VIDEO, EFFECTS AND ARCHITECTURAL LIGHTING WITH BOWLING SCORING SYSTEM AND METHODS OF USE

CROSS-REFERENCE TO RELATED APPLICATIONS

This patent document claims priority to, and is a continuation-in-part of, U.S. patent application Ser. No. 14/257,301, filed Apr. 21, 2014, titled "INTERACTION OF AUDIO, VIDEO, EFFECTS AND ARCHITECTURAL LIGHTING WITH BOWLING SCORING SYSTEM AND METHODS OF USE." The disclosures of the priority documents listed above are fully incorporated into this document by reference.

FIELD OF THE INVENTION

The present disclosure relates to bowling systems and, more particularly, to interactive bowling systems using scoring systems and/or other computer infrastructures which interact with visual and/or audio effects within the bowling center.

BACKGROUND

Bowling is a very popular sport for both recreational bowlers and league bowlers. For recreational bowlers, bowling is a leisure activity which can be played at most any time of the day and throughout the year, regardless of weather. The game of bowling has also become very popular for families as well as adults of all ages.

Bowling has many different games including, for example, ten-pin, nine-pin, candlepin, duckpin, five-pin bowling and mini-bowling. Today, the sport of bowling is enjoyed throughout the world.

SUMMARY

According to an aspect of the present disclosure, a system for providing an interactive bowling experience is provided. The system includes a management system which includes a memory and a processing device. The system further includes a non-transitory computer readable medium in communication with the processing device, the computer readable medium storing one or more programming instructions that, when executed, cause the processing device to store a listing of one or more trigger events as well as any special effects associated with each trigger event, monitor at least a portion of activity within a bowling center for detection of an occurrence of a trigger event, and determine whether a trigger event has occurred. If a trigger event is determined to have occurred, the one or more programming instructions, when executed, cause the processing device to determine one or more special effects associated with the trigger event. The special effects include one or more of displaying one or more graphics onto one or more bowling pins, activating one or more lighting effects onto a ball return system, or activating one or more lighting or vibratory events at a seating location of a user. The one or more programming instructions, when executed, further cause the processing device to provide instructions to one or more special effect components to perform the one or more special effects associated with the trigger event.

According to various embodiments, the one or more trigger events comprise at least one of a strike or a sequence of strikes, gutter balls, a high score, a perfect score, a score over a particular value, and a start of a user's turn.

According to various embodiments, the one or more special effect components comprise at least one of a video display, a video projector, an audio system, a tactile feedback system and an architectural lighting system.

According to various embodiments, the one or more special effects comprise at least one of video projection effects, multi-colored lighting effects, ultra-violet lighting effects, laser effects, audio effects, fog effects, haze effects, carbon dioxide effects, snow effects, bubble effects and confetti effects.

According to various embodiments, the one or more programming instructions further comprise instructions for thereby causing the management system to receive, from at least one input device, initialization information related to operation of the at least a portion of the bowling center.

According to various embodiments, the initialization information comprises at least one of a type of game to be played, one or more player names, one or more player ages, and a selection of one or more special effects that can be triggered during play.

According to various embodiments, detection of an occurrence of a trigger event is detected by at least one of a scoring system, a security system, one or more cameras, one or more proximity sensors, one or more pressure sensors and one or more motion sensors.

According to various embodiments, the programming instructions are further configured to cause the processor to determine a location of a user.

According to various embodiments, the system further includes one or more tracking tags configured to be worn by the user.

According to various embodiments, the system further includes one or more shoes, wherein the one or more tracking tags are housed within the one or more shoes.

According to various embodiments, the programming instructions are further configured to cause the processor to determine if the one or more shoes have been removed from the bowling center.

According to various embodiments, the programming instructions are further configured to cause the processor to generate a notification when it has been determined that the one or more shoes have been removed from the bowling center.

According to various embodiments, the location of the user is a seat within the bowling center, and activating the one or more lighting or vibratory events at a seating location of a user includes activating the one or more lighting or vibratory events at the seat within the bowling center at which the user is located.

According to another aspect of the present disclosure, a method for providing an interactive bowling experience is provided. The method includes storing, by a management system, a listing of one or more trigger events as well as any special effects associated with each of the one or more trigger events, receiving, by the management system, from at least one input device, initialization information related to operation of the at least a portion of a bowling center, receiving, by the management system, event occurrence information from one or more detection devices, monitoring, by the management system, the event occurrence information for occurrence of a trigger event having at least one associated special effect, and determining, by the management system, whether a trigger event having at least one associated special effect has occurred. The method further includes, in response to a trigger event having at least one associated special effect occurring, determining, by the management system, one or more special effects associated with the trigger event, and providing, by the management system, instructions to one or more special effect components to perform the one or more special effects associated with the trigger event. The special effects include one or more of displaying one or more graphics onto one or more bowling pins, activating one or more lighting effects onto a ball return system, or activating one or more lighting or vibratory events at a seating location of a user.

According to various embodiments, the one or more trigger events comprise at least one of a strike or a sequence of strikes, gutter balls, a high score, a perfect score, a score over a particular value, and a start of a user's turn.

According to various embodiments, the method further includes determining a location of a user using one or more tracking tags configured to be worn by the user.

According to various embodiments, the one or more tracking tags are housed within the one or more shoes.

According to various embodiments, the method further includes determining if the one or more shoes have been removed from the bowling center.

According to various embodiments, the method further includes generating a notification when it has been determined that the one or more shoes have been removed from the bowling center.

According to various embodiments, the location of the user is a seat within the bowling center, and activating the one or more lighting or vibratory events at a seating location of a user includes activating the one or more lighting or vibratory events at the seat within the bowling center at which the user is located.

BRIEF DESCRIPTION OF THE DRAWINGS

The present disclosure is described in the detailed description which follows, in reference to the noted plurality of drawings by way of non-limiting examples of exemplary embodiments of the present disclosure.

DETAILED DESCRIPTION

Figure 1:
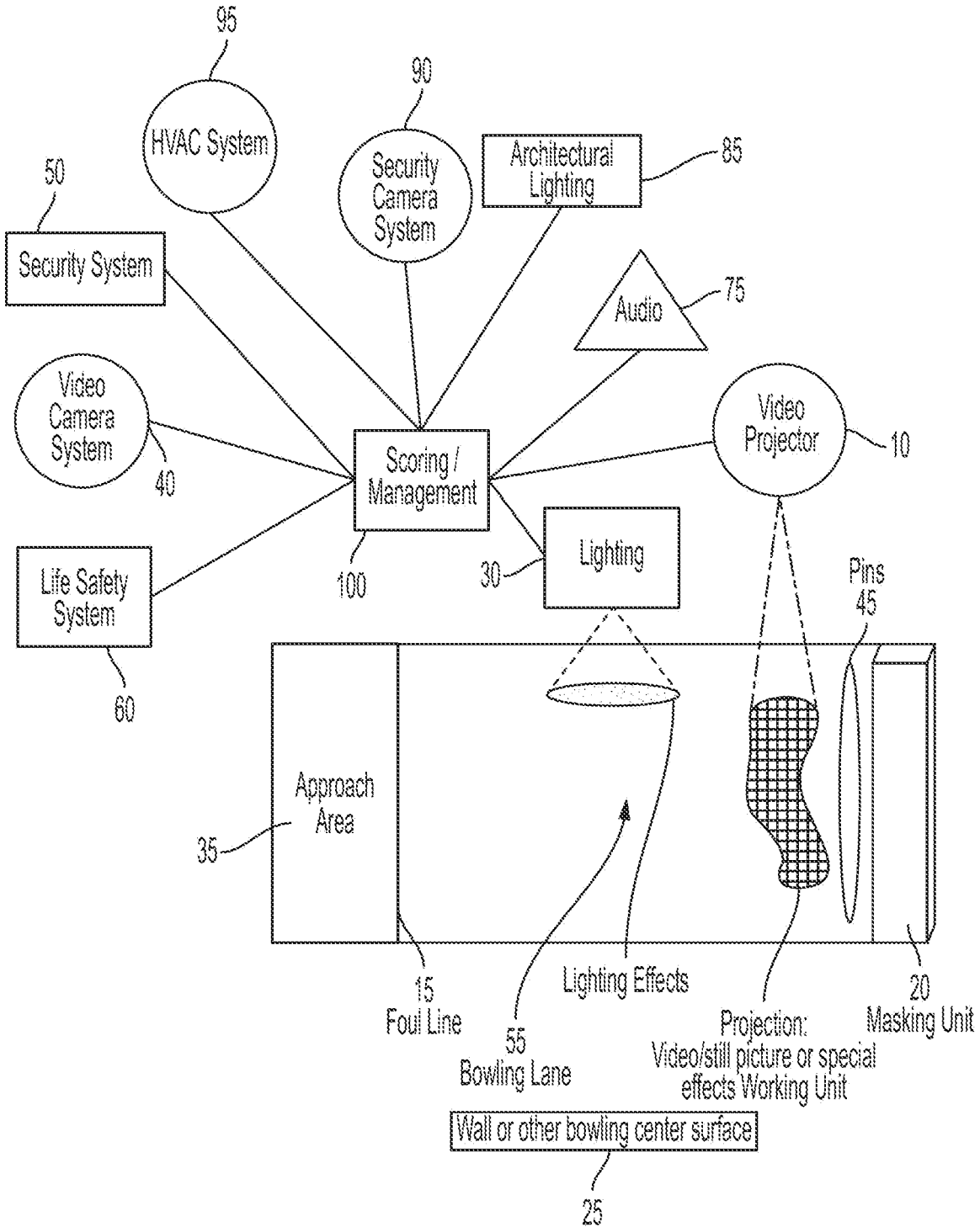
FIG. 1 shows a representative bowling center according to an embodiment.

This disclosure is not limited to the particular systems, devices and methods described, as these may vary. The terminology used in the description is for the purpose of describing the particular versions or embodiments only, and is not intended to limit the scope.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

The present disclosure relates to bowling systems and, more particularly, to interactive bowling systems comprising scoring systems and/or other computer infrastructures of the bowling center which interacts with and/or manages special effects within the bowling center. This includes using the bowling scoring system to interact with the management and/or automation system to control and manage the audio, video, effects and architectural lighting, HVAC system, security system, security camera system, life safety system, video camera system and provide complete building management.

In one or more embodiments, the interactive bowling systems can be triggered by, for example, bowling events. As used herein, bowling events refer to, for example, a strike or a sequence of strikes, gutter balls, a high score (e.g., a perfect score), a score over a particular value (e.g., a score over 200), and other triggering events occurring on any lane or combination of lanes or within, generally, the bowling center. Advantageously, the events can be triggered automatically using, for example, an existing scoring system (scoring console) or other detection systems which include, but are not limited to, cameras, proximity, pressure and motion sensors, with connections to and managed by a central management system.

As used herein, special effects refer to, for example, any entertainment related effect that enhances the bowling game experience. These special effects can include, but are not limited to, video projection, flat panel video displays, LED video displays, multi-colored lighting, ultra-violet lighting, laser effects, audio effects, and/or fog/haze/CO2/snow/bubble/confetti effects, which may or may not contain cameras or sensors for interactivity with the bowler and/or the bowling ball. It should be understood by those of ordinary skill in the art that these special effects noted herein are merely illustrative examples, and that other effects, whether they are visual, audio or tactile, are contemplated by the present disclosure.

In embodiments, the present disclosure contemplates interacting special effects with a bowling scoring and management system and special effects control. In this way, the bowling scoring and/or management and special effects control systems of a bowling center can control and/or manage the special effects to be delivered within the bowling center. This provides an interactive experience having some meaningful environmental interaction based on information available to a bowling scoring system, management system and special effects control. This information can be, illustratively, detection of a person or bowling ball at a certain location within the bowling center (e.g., crossing over a foul line), scoring events such as a strike, a gutter ball, speed and tracking of a bowling ball, and other similar information.

Thus, the present disclosure relates to an interactive system including special effects used in bowling centers, managed by a bowling scoring and/or management system and/or special effects control. This allows the special effects content to respond to the scoring games and events occurring on the bowling lane and that are known and managed usually by the scoring system, management system and special effects controls and within the bowling center. The result is that the bowling scoring, management system and special effects control can drive and also affect the special effects content (either with or without a camera/detection device for interactivity with the bowler and/or bowling ball).

Referring to FIG. 1, in a sample embodiment, the control system can utilize a video projection system 10 to display special effects, video/still content, and/or video/still images recorded in the bowling center and projected onto bowling center surfaces and/or onto video displays. Bowling center surfaces can be, for example, floors 15, walls 25, ceilings 25, masking units 20, bowling pins 45, bowling lanes 55, and bowler approaches 35 in the bowling center, amongst other surfaces. It should be understood by those of ordinary skill in the art, though, that these bowling center surfaces are merely illustrative examples, and that projecting special effects on any surface within the bowling center are contemplated by the present disclosure, including, for example, any surface of any system that is used in the bowling center.

More specifically, in one or more embodiments, the special effects can include a video projector system 10 which includes, for example, one or more video projector units and/or automated video projection units configured to project video content onto a masking unit 20 at the end of the bowling lanes that is suitable to receive this content, with either front or rear projection systems, as well as projecting content onto the bowling lane 55 or approach area 35 or bowling pins 45, or any other surface or combination or surfaces in the bowling center 25 to add video content and/or effect to the bowling center environment. In one or more embodiments, the special effects may include a video projection system 10 that incorporates a camera or other detection device (see, e.g., FIG. 4 as described below) to identify people and/or objects that cross onto the video projection surface area, camera and/or sensor equipped areas and/or other locations within the bowling center. Such a detection device can enable the systems of the present disclosure, e.g., bowling scoring, management system and special effects control 100, to react and change the image, video content (or other special effect) being displayed by the video projection system 10 according to the motion of the person or object/objects in the video projection display area, or other similar events that may occur during bowling that can be observed by the detection devices.

In additional embodiments, the present disclosure may implement the use of multi-color lighting fixtures 30, e.g., LED lighting, automated light fixtures above the bowling lanes in which the multicolor lighting fixtures (e.g., LED lighting fixtures) project lighting effects onto the bowling lane surface 55, wall surface 25, masking unit 20, bowling pins 45, approach area 35 (or any other surfaces or lighting effects), changing the color appearance of the lane surface (or other surface of the bowling center or lighting effects) and creating a visual effect on the bowling lanes (or other surface of the bowling center or lighting effects), each of which can be controlled by a scoring system and/or centralized management system. The special effects can also include sound/audio systems 75 and other effects such as fog/haze/CO2/snow/bubble/confetti machines, rotating, moving, automated effects lights, lasers, architectural lighting, mirrored effects, etc., all of which are represented by reference numbers 10 and 30 as shown in FIG. 1.

FIG. 1, for example, also discloses linking of audio 75, architectural lighting 85, security camera system 90, HVAC system 95, video camera systems 40, security system 50, and life safety system 60 to management system 100. The interconnection of the scoring and management systems provides one central control system for controlling all, or nearly all, operational aspects of the bowling center into one, central control system.

Figure 2:
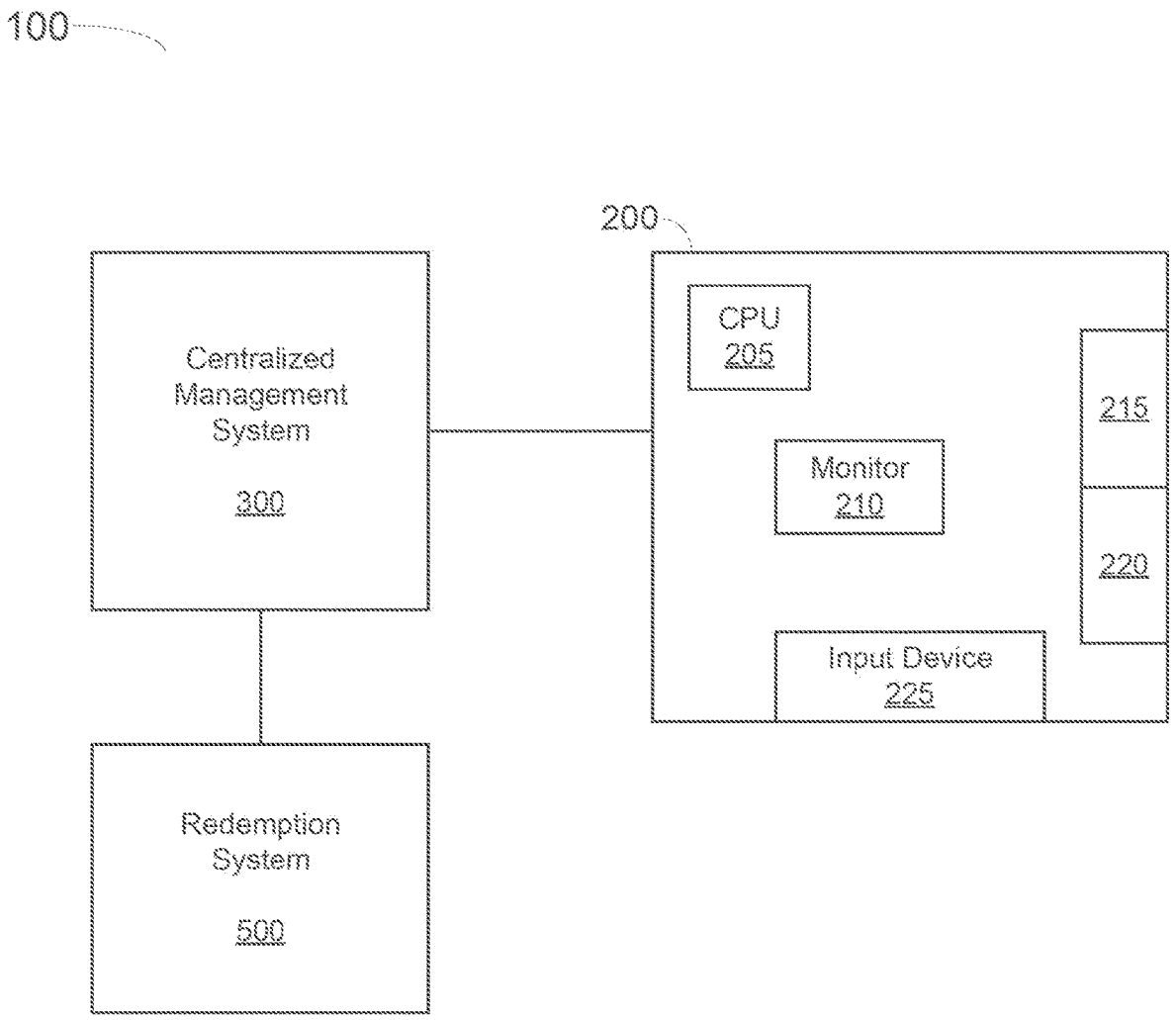
FIG. 2 shows a representative bowling scoring and management system for implementing aspects of the present disclosure according to an embodiment.

As shown in FIG. 2, in embodiments, the bowling center includes a bowling scoring, management system and special effects control 100. The bowling scoring, management system and special effects control 100 comprises, for example, various features including a lane score computer, a centralized management system and special effect control, a redemption system, and representative computer infrastructure. These, and additional features, are discussed in greater detail in the following discussion.

Lane Score Computer

The lane-score-computer (also referred to as the scoring system) 200 is a computerized system that manages games on a lane, or a multiple lanes, as should be known to those of skill in the art. The scoring system 200 is discussed in more detail with reference to FIG. 3. In embodiments, the example described herein assumes one pair of lanes; although other configurations are also contemplated by the present disclosure. In embodiments, the scoring system 200 includes a main CPU 205 that is connected to:

I. A local monitor 210 (typically overhead display monitor above the lane). This monitor 210 can display bowling information including, for example, bowling scores and other bowling related information including messages, etc., to the bowler;

II. I/O devices 215 to interface with the pinspotting machines;

III. I/O devices 220 to collect information regarding when a ball is thrown, how many pins have fallen, if a foul has been detected, and other information available on the lane about the ball that was bowled; and IV. I/O console device 225 configured to allow the scoring system to interact locally on the lane with the bowlers.

In embodiments, the I/O console device 225 includes, for example, a keypad (e.g., a touch screen or other similar input device) configured to receive inputs from a bowler or other user. For example, the bowler can enter the names of each bowler, as well as other pertinent information. In embodiments, the I/O console device 225 can also allow the bowler or other user to enter triggering events and associated special effects, in order to trigger the programmed special effects. For example, the bowler can enter a command via the I/O console device 225 indicating that the lights are to flash when, for example, a bowler has a strike or a gutter ball, the bowler passes over the foul line, or any combination of actions that can occur, as further described herein.

Centralized Management System and Special Effect Control

The centralized management system and special effects control 300 is a computerized system including one or more computers located at, for example, the counters and back office and/or the electrical and HVAC storage areas of the bowling center. The centralized management system and special effects control 300 is discussed in greater detail below with reference to FIG. 3.

In embodiments, for example, the centralized management system, special effects control 300 and scoring systems 200 communicate with each other. The centralized management system 300 can allow the manager/employees of the bowling center to manage the customers (bowlers) from check-in to check-out. One of the many functions performed by the management system 300 is to send the necessary information to set up the scoring system 200, for each bowler and bowling game to be played for each lane. At the end of the game, the centralized management system 300 can collects the necessary information from the scoring system 200 in order to manage the game scores, rankings, payments, and other information related to the completed game. In addition, the central management and special effects control 100 provide the control and interface with the effects lighting systems 30, architectural lighting system 85, audio system 75, video system 10, security camera system 90, security system 50, life safety system 60, video camera system 40 and HVAC system 95.

Alternatively or additionally, the centralized management system 300 may operate in concert with an automation system configured to connect various aspects of the bowling system. For example, the automation system can provide an overall control for operating and managing all other systems within the bowling center, including receiving commands from the bowling system and various tracking/monitoring devices and executing preset responses. However, for discussion purposes, the functionality of the automation system will be described in relation to the management system 300 as discussed herein.

Figure 3:
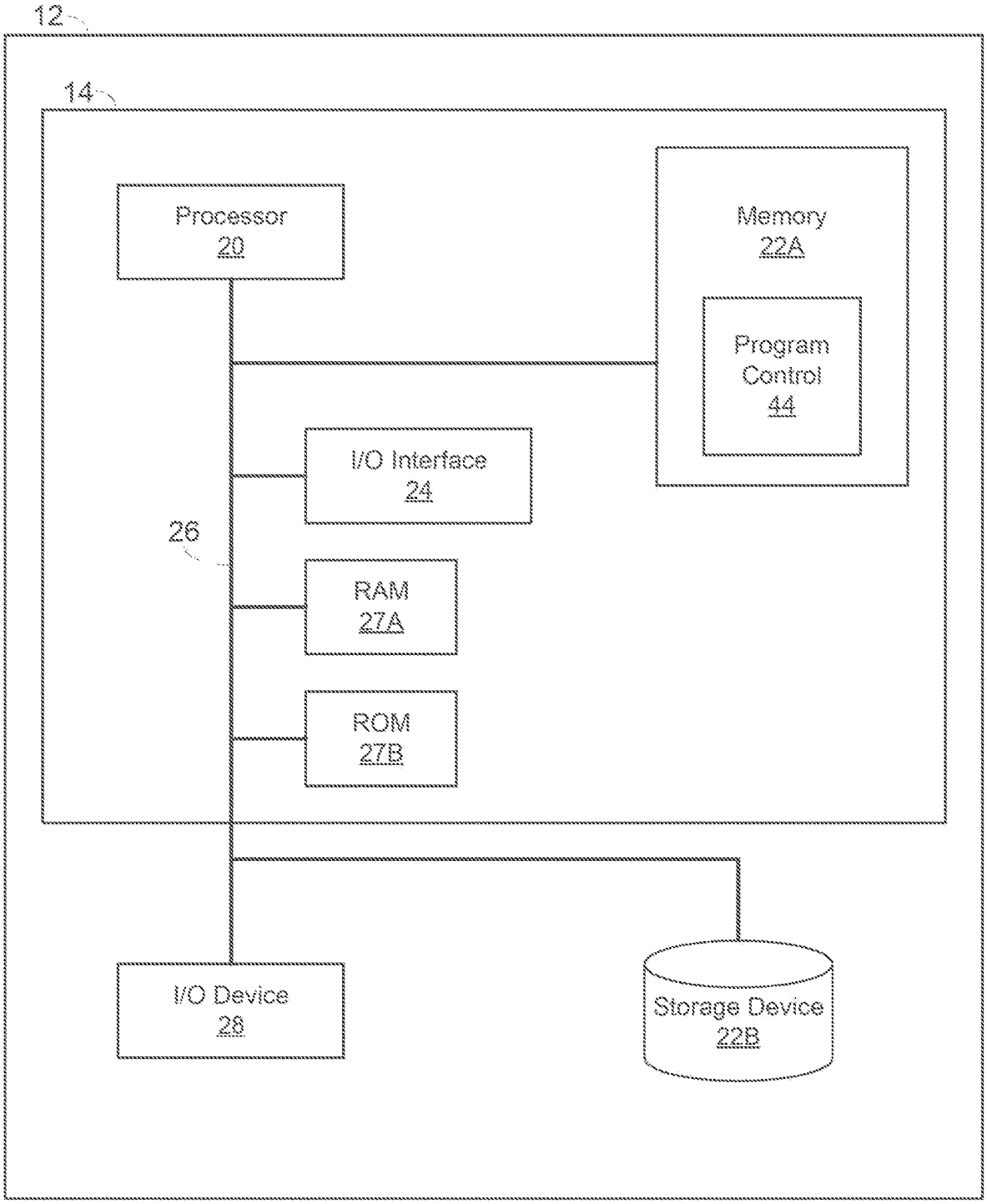
FIG. 3 shows a representative system infrastructure according to an embodiment.

In one or more embodiments, the centralized management system 300 controls/manages any of the features of the present disclosure as described with regard to FIGS. 2 and 3. More specifically, a user can enter any combination of triggering events and associated special effects into the centralized management system 300 via the scoring system 200 as described above. Upon the occurrence of the triggering event(s), the centralized management system 300 can then instruct the video 10, lighting 30, video camera system 40 and audio 75 systems, for example, to provide the programmed special effects. Central management system 300 also provides the user interface for the security camera system 90, security system 50, life safety system 60, architectural lighting system 85 and HVAC system 95.

In additional embodiments, the triggering event can be provided by a bowler, for example, by inputting a desired triggering event or combination of triggering events into the scoring system 200. The bowler can also enter a desired special effect from a list of preprogrammed special effects. The scoring system 200 will, in turn, provide the programmed triggering events to the centralized management system 300. Upon the occurrence of the triggering event, which may be determined and/or monitored by the scoring system 200, or special effect control 300 e.g., a strike on a specific lane, the scoring system 200 will notify the centralized management system 300 of such triggering event, in which scenario, the centralized management system 300 will instruct the video system 10, lighting 30, audio 75, video camera system 40 for example, to provide the associated programmed special effects.

In additional embodiments, the central management systems provides the control interface for the HVAC system 95, security camera system 90 and architectural lighting 85, security system 50 and life safety system 60.

Redemption System

Integrated with the centralized management system and special effects control 300 and/or the scoring system 200 is a redemption device 500. The redemption device can deliver tickets, virtual tickets, and/or tokens as images projected onto the lane surface 55, approach area 35, masking unit 20 or bowling pins 45 in any combination of the surfaces or areas. This includes virtual "colored pin" for games and redemption purposes with programmed interaction by the scoring system 200.

Representative Computer Infrastructure

FIG. 3 shows a representative computer infrastructure, which can be representative of a bowling scoring and/or management system and/or special effects control of the present disclosure. Illustratively, the computer infrastructure can be representative of either the scoring system 200 or centralized management system and special effects control 300.

To this extent, the computer infrastructure can include a server, media player or other computing system 12 that can perform the processes described herein. In particular, the server 12 can include, or be operably connected to, a computing device 14. The server 12 and/or computing device 14 can communicate over any communication link such as an intranet, a local area network (LAN), a wide area network (WAN) such as the Internet, serial, Ethernet or a digital multiplexed network (DMX) contact closure, ASCII, HEX, infrared, and other common communication protocols and techniques. For example, the scoring system 200 can communicate with the centralized management system 300 using an intranet, LAN, WAN, Internet, or other similar connection. The computing device 14 can be resident on a network infrastructure or computing device of a third party service provider provided and stored at a remote location.

The computing device 14 can also include a processor 20, memory 22A, an I/O interface 24, and a bus 26 for operably connecting the various components within the computing device. In addition, the computing device includes random access memory (RAM) 27A, a read-only memory (ROM) 27B, and an operating system (O/S) stored within memory such as memory 22A. The computing device 14 can be in communication with the external I/O device/resource 28 and the storage system 22B. The I/O device 28 can include any device that enables an individual to interact with the computing device 14 (e.g., user interface) or any device that enables the computing device 14 to communicate with one or more other computing devices using any type of communications link. The external I/O device/resource 28 may be for example, a handheld device, PDA, handset, keyboard, touch panel, smart phone, tablet computer, etc.

In general, the processor 20 executes computer program code (e.g., program control 44), which can be stored in the memory 22A and/or storage system 22B. The program control 44 provides the processes described herein. The program control 44 can be implemented as one or more program codes stored in memory 22A as separate or combined modules. Additionally, the program control 44 may be implemented as separate dedicated processors or a single or several processors to provide the function of these tools. While executing the computer program code, the processor 20 can read and/or write data to/from memory 22A, storage system 22B, and/or I/O interface 24. The bus 26 provides a communications link between each of the components in the computing device 14.

As will be appreciated by one skilled in the art, the techniques and processes as described herein may be embodied as a system, method or computer program product. Accordingly, aspects of the present disclosure may take the form of an entirely hardware embodiment, an entirely software-based embodiment (including firmware, resident software, micro-code, etc.) or an embodiment combining software and hardware aspects.

Furthermore, aspects of the present disclosure may take the form of a computer program product embodied in one or more computer readable medium(s) having computer readable program code embodied thereon. Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

According to aspects of the present disclosure, the scoring system and/or a management system manages special effects content based on a certain triggering event. More specifically, in one or more embodiments, the special effects devices (e.g., video system 10 of FIG. 1) can be provided near the lanes or in other sections of the bowling center. The special effects devices can be managed directly by the centralized management system 300 through direct commands sent on a standard or proprietary protocol (e.g., serial communication, Ethernet, DMX). They can also be managed by a dedicated service separated from the centralized management system 300, intended, for example, as a dedicated server machine, running a specific software which receives inputs from the centralized management system 300 and translates these inputs into commands for each special effect device connected to it, also in this case using a defined communication protocol running for example on a standard network connection, or using proprietary protocols such as serial, Ethernet or DMX contact closure, ASCII, HEX, infrared and other similar protocols.

According to aspects of the present disclosure, management system manages HVAC system 95, security system 50, life safety system 60, security camera system 90 and architectural lighting 85 content based on an input from the bowling center manager/user/operator from the user interface (e.g., a touch panel interface) or by scheduled or programmed events. More specifically, in embodiments, the HVAC system 95, security system 50, life safety system 60, security camera system 90 and architectural lighting 85 of FIG. 1 can be provided throughout the bowling center. All of these systems can be managed directly by the centralized management system 300 through direct commands sent on a standard or proprietary protocol (serial communication, Ethernet, DMX, Bluetooth, contact closure, ASCII, HEX, infrared). They can also be managed by a dedicated service separated from the centralized management system 300, intended for example as a dedicated server machine, running a specific software which receives inputs from the centralized management system 300 and translates these inputs into commands for each specific system connected to it, also in this case using a defined communication protocol running for example on a standard network connection, or using proprietary protocols such as serial, Ethernet, infrared, ASCII, HEX, contact closure or DMX or other similar protocol.

The centralized management system 300 can be an independent centralized computerized system able to know the specific "modality" of the bowling center at every moment. For example, the centralized management system 300 may always "know" the state of each lane such as open/close, how many bowlers are playing, which kind of game they are playing, if there are children using bumpers, if the lane is in open play or in League mode, and so on. The state of each lane can be set up manually by the front desk operator, manually by the bowlers on the lane through the bowler consoles of the scoring system 200, automatically through a bowling modes feature, or completely online by a customer and their payment method.

The central management system can also know the "modality" of many other areas of the bowling center. These areas include and are not limited to the state of the HVAC system 95 with the ability to monitor and change the temperature in every HVAC zone/room by operating the thermostats by the central control system 300. In one or more embodiment, the central management system can also: control the audio system 75 with volume level and source in all zones; operate, view and monitor the security camera system 90; manage and operate the architectural lighting system 85 with power and dimming controls for the entire interior and exterior of the building and parking lot; monitor and operate the entire video system 10 with all video input sources, DVD players, media players, digital signage players and all video output displays; control and operate the effects lighting system 30 and all of the special effects devices. (including, for example, all fog/haze/CO2/snow/bubble/confetti machines, rotating, moving, automated effects lights, lasers, architectural lighting, mirrored effects, and other similar special effects); control and operate the video camera system 40; control and manage the security system 50; and control and manage the state of the life safety system 60 in connection with the state of the fire detection system. The state of each system in the bowling center can be set up manually either on-site or remotely or by scheduled events by the front desk operator, manager, bowling proprietor through the management system 300, or remote device bowler handheld device, PDA, handset, keyboard, touch panel, smart phone, tablet computer, or other similar computing device.

In one or more embodiments, "bowling modes" refers to a feature of the centralized management system 300 that allows a user to define and program on a predefined schedule a set of parameters related to each lane's status, such as the type of game (open play, league, tournament), status of optional accessories (bumpers, glow-in-the-dark lighting), availability of specific games, background grids or video animations on the lanes. This provides for a complete and automated customization of the bowling environment throughout the center and throughout the day, week, month or year. As an example, the bowling center can be set to automatically switch to glow-in-the-dark lighting, go to a specific volume level, switch any or all TV channels, run programmed advertising specials, dim architectural lighting levels, adjust thermostat heating/cooling levels at a certain time on certain days of the week, month or year e.g., every Friday starting from 10 PM or every Wednesday at 4 PM certain lanes are set for open play with children which are set to display only animations and games targeted to children with children's music. All of this control can be zone, area or room specific, or can be set to include the entire facility. This also includes management of the entire building with scheduled events for opening and closing procedures with control of architectural lighting 85, lighting 30, video system 10, HVAC system 95, audio 75, video camera system 40, security 50 and life safety 60 systems.

The scoring system 200, on the other hand, refers to the equipment related to the lanes, including a scoring CPU, a bowler console for interaction with bowlers, and monitor where scoring information is displayed (or other video content managed by the scoring system 100), an interface with the pinspotter equipment and a device for detecting the pin count and the speed of the ball. The scoring system 200 is responsible for storing a set of data related to the bowler (name, handicap, left-right handed) and for detecting and processing all game-related events on the lane (e.g., each bowler's scoring, how many frames have been played, etc.). In one or more embodiments, the scoring system 200 can be connected and integrated with the centralized management system 300, in such a way that data is continuously exchanged between these components. As an example, the centralized management system 300 can instruct the scoring system 200 by sending information related to what type or types of games can be played or what the bowlers' names are, and the scoring system sends to the centralized management system 300 information related to the events happening on the lanes, such as the scoring of each bowler, or bowling shot information by each bowler on each of the lanes, and/or other similar information. These events can then be used to trigger a special effect or multiple effects.

In embodiments, the centralized management system 300 can use the inputs coming from the scoring system 200 to trigger the command for specific special effects, directly after a specific event happens (e.g., every time anyone in the center scores a strike, a flashing word "Strike!" is displayed on the masking unit video displays, and/or a predefined light pattern is projected on the lanes by ceiling-mounted RGB LED lights or LED lane capping lights and architectural lighting change color and/or pattern or specific video/still images are displayed on bowling pins or any combination of special effects). To extend this feature, the present disclosure can be combined with the bowling modes to set a number of predefined commands that the centralized management system 300 can send to any of the special effects devices according to the state of the lanes and the events happening on each lane, sent in real time from the scoring system 200 or special effects controls 300.

In embodiments, the interaction between the centralized management system 300 and specific ongoing "events" determines the special effects as multi-colored lighting, laser effects, audio effects, fog, and/or other similar special effects. Events may include the following examples, amongst others as described throughout the present disclosure.

Individual game events or a combination of events happening on one or more lanes, e.g., one strike, a series of strikes, a certain score, and other similar events may trigger a special effect. In this example, the scoring system 200 can detect these events and send this information to the centralized management system 300 that, after cross referencing the input with the "modality" of the center in that moment if bowling modes is active, generates some specific special effects (lighting, sound or video in any/all combination).

The system administrator (center proprietor, manager, or reception/front desk operator) can send some specific inputs to the centralized management system 300 through any terminal belonging to the centralized management system 300 (such as front desk reception terminals). In this example, the system administrator can communicate that all the customers on a specific lane are children. At this point, the centralized management system 300, using this specific data, will know exactly which specific special effects, with audio and/or video content, to generate based upon this information. These effects can be for a specific or combination of lanes. By way of example, if there are three strikes on three different lanes, the centralized management system 300 can trigger a fog effect on the lanes or a special lighting effect on the entire facility.

The game players (e.g., bowlers of the games) can send specific input directly to the scoring system 200 through the lane bowler console in order to provide a triggering event and special effect. For example, a player can choose that a certain color is projected on the lane after an occurrence of an event. In this example, the scoring system 200 will send this input to the centralized management system 300 that, cross referencing this information with the specific "modality" of the center in that moment, if active, will send a command to a projector, light fixture or special effect mounted on the lane to project a chosen video, still image, or color on the lane.

Accordingly, in one or more embodiments, the centralized management system 300, in addition to being the system that generates the "modality" of the bowling center, can also be the "collector" of all inputs that are obtained by the scoring system 200, tracking cameras 415, proximity sensors 100, pressure sensors 95, by the system administrator and/or by game players (again through the scoring system). Once collected, and depending on the specific combination, the centralized management system 300 can determine which specific special effects to generate on one lane, multiple lanes, at other locations within the bowling center and any combination thereof.

The central management system 300 and scoring system 200 can include additional input or triggers from the security system 50 and the life safety system 60. For example, the security system monitors activity within the bowling center. If the center is burglarized after normal operating hours, the security system detects the intrusion then contacts the authorities/police, owners and management. The central management system 300 can send signals to raise all of the architectural lighting levels in the architectural lighting system 85 and switch video camera system 40 on to record and capture additional video footage of the intrusion. The life safety system can be triggered by a fire alarm which then communicates with the central management system 300. The central management system can then mute the audio system 75, raise all architectural lighting 85 levels, shut off the effects lighting 30, video projection system 10, and trigger the scoring system 200 shut down the bowling equipment. Any additional equipment and or games in the arcade or other areas can also be shut down. Additional life safety systems can include panic stations 105 located in any part of the establishment and/or on the management system 300 user interfaces to notify authorities of trouble/burglaries/Adam alerts etc. When an event like these happen, all of the central management system 300 user interfaces (touch panels/controls) would provide details of the event. These events would have to be cleared before the normal operation of the establishment could proceed.

Representative Bowling Center

Figure 4:
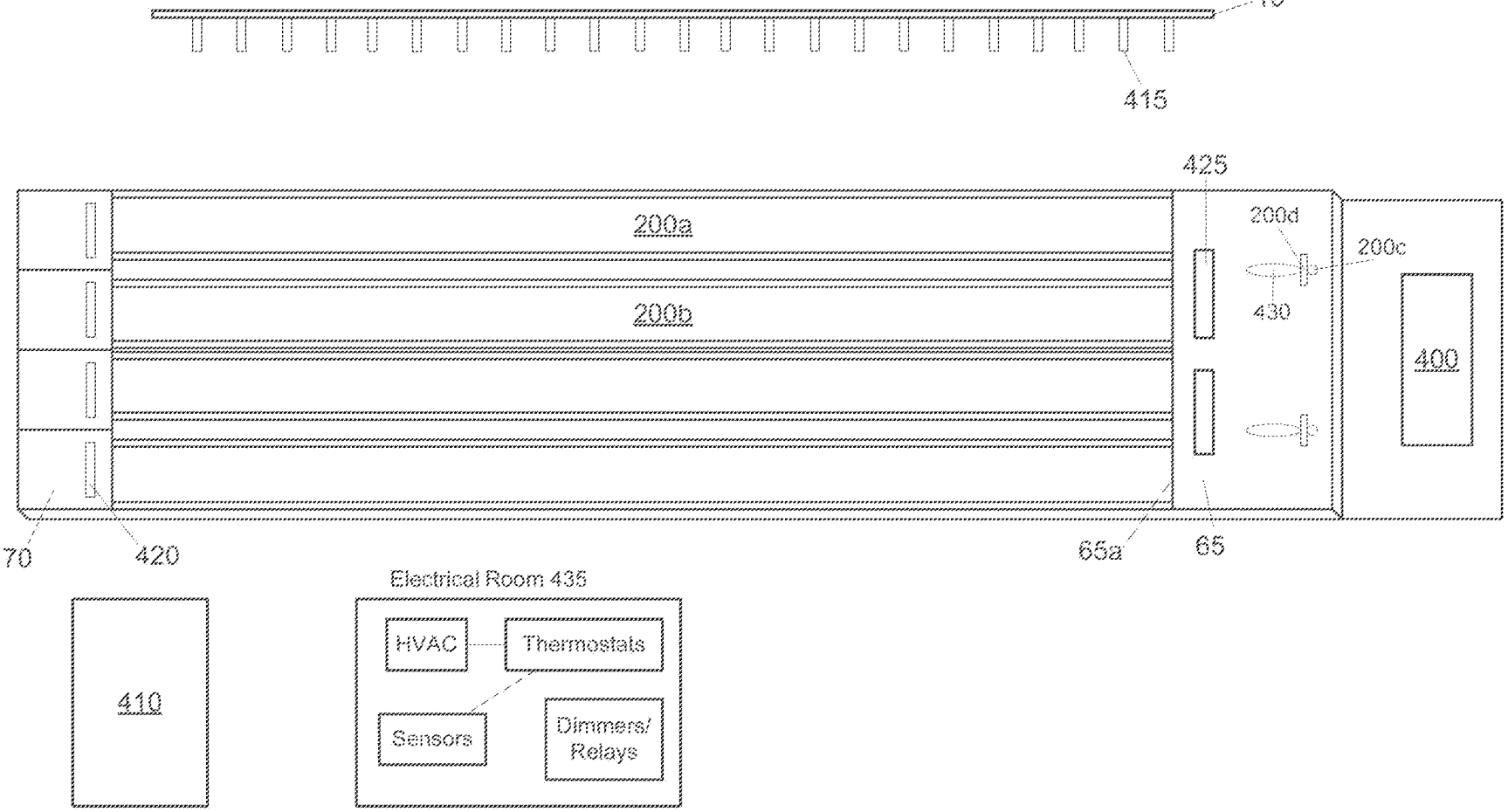
FIG. 4 shows another representative bowling center according to an embodiment.

FIG. 4 shows another representative bowling center in accordance with aspects of the present disclosure. More specifically, FIG. 4 shows several components and interactions amongst the components in the bowling center. For example, FIG. 4 shows a front desk 400, back office 410, electrical room 435, either of which may store any combination of the components of the centralized management system 300. For example, in embodiments, the monitor and input devices of the centralized management system 300 may reside at the front desk 400; whereas, the servers for the centralized management system 300 may reside in the back office 410, the dimming and relay controls and additional lighting controls for the centralized management system 300 may reside in the electrical room 435, HVAC temperature sensors would reside in each zone or room of the bowling center (FIG. 4). HVAC thermostats general will reside in the electrical room 435.

Further, in the bowling center representation of FIG. 4, the scoring system 200 is shown to be paired with two lanes each, 200*a*, 200*b*. As shown, the scoring system 200 includes an input component, e.g., keypad or touch panel 200*c*, and a monitor 200*d*. Additionally, the input components can include an image capture device such as a camera for capturing an image of a bowler for inclusion and display by the scoring system 200 as well as, for example, posting to a website or social media web page related to the bowling center or the bowler's own web or social media online accounts. Similarly, the input component can include a biometric reader, either as a separate component or, for example, integrated into a touch panel, to recall previously stored information related to a bowler such as demographic and personal information, previous performance statistics, preferred system settings, and other similar information.

FIG. 4 further shows the projection system 10, which can comprise lighting and other special effects as described herein. A tracking camera (system) 415 includes infrared lighting 425 is also provided, for example, overhead of the bowling lanes 200*a*, 200*b*. The tracking camera (system) 415 can be positioned at other locations of the bowling center and preferably has an overview of the bowling center, including the lanes 200*a*, 200*b*, the approach area 65 and foul line 65*a*, and other related areas. In one or more embodiments, the tracking camera system 415 can be a laser or other motion detection system that is positioned at the foul line 65*a*, to determine whether a bowler has stepped over the foul line during a bowling event or as trigger for any or all of the special effects.

In additional embodiments, the tracking system 415 can track movement of objects, e.g., bowling pins, bowling balls, as well as bowlers and other similar objects, and provide such information to the centralized management system 300. Also, pressure sensors 95 can detect bowlers and their location in the bowling center and provide this information to the centralized management system 300. Proximity sensors 100 can be used to track the location and speed of rolled bowling balls on lanes 200*a* and 200*b*. This information can also be sent to the centralized management system 300. The centralized management system 300 can use this information to determine if such event is a triggering event for a special effect, and, if so, then instruct the special effects component(s) to provide the associated special effects, e.g., lighting, fog, or other interactions. By way of example, the tracking camera (system) 415 and/or pressure sensors 95 can determine that a person is in the approach area 65 and, if another person on the adjacent lane is bowling, instruct the special effects component, e.g., projector, to project an image or word(s) on the approach requesting that the bowler wait unit the other bowler in the adjacent lane has released the bowling ball. The tracking camera system 415 and infrared lighting 425 can track a rolled bowling ball, communicate with the central management system and instruct the video system 10 to project video on and/or around rolled bowling ball down the lanes 200*a* and 200*b*. Proximity sensors 100 tracking the rolled bowling ball down the lane can instruct the central management system have the LED lane lights follow the ball down the lanes 200*a* and 200*b*. The pit area 70 can include special effect equipment such as pit lighting 420 e.g. LED, fluorescent, ultra-violet and or pin video projections 85 under the masking unit or pin deck 35 for additional tracking effects/visual effects/animations.

A plurality of overhead monitors 425 can also be provided in the bowling center. In embodiments, much like the other visual effects components of the present disclosure, these overhead monitors 425 can provide visual effects upon a triggering event, as controlled by the centralized management system 300. For example, the visual effects can be animations or other effects.

The bowling center of FIG. 4 also includes other bowling related components such as a ball return system 430. In embodiments, the visual and special effects can be provided on any surface of the bowling center, including the ball return system 430.

As shown in FIG. 4, the various components included within the bowling center may be operably connected via wired and/or wireless connections. For example, the scoring system 200 may have a wired connection to the centralized management system 300. However, one or more of the special effect components (such as the pit lighting 420) or one or more of the monitoring components (such as the tracking camera system 415) may be operably connected to the centralized management system 300 via a wireless connection.

Sample Process for Providing an Interactive Experience

Figure 5:
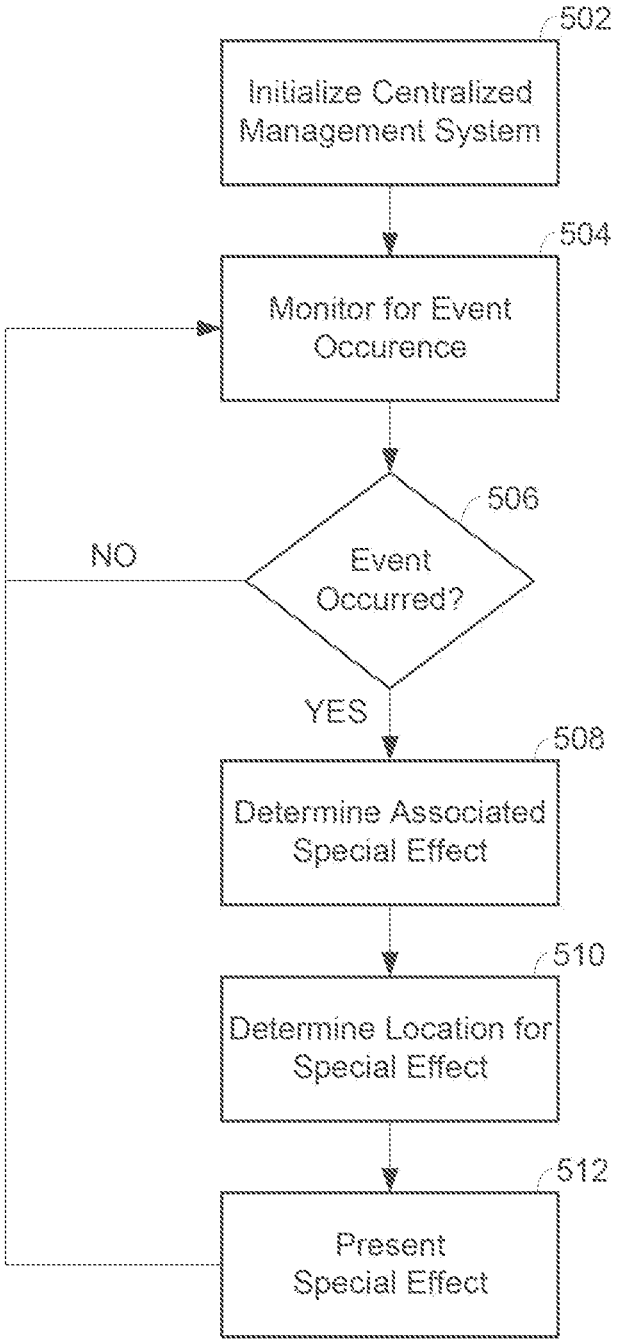
FIG. 5 shows a sample process for providing one or more special effects in response to a bowling event according to an embodiment.

FIG. 5 illustrates a sample process for using the techniques as described herein to provide an interactive bowling experience according to one or more embodiments. The centralized management system is initialized 502. As described above, an employee at the bowling center may start the initialization process by turning on or activating one or more lanes, as well as assigning the type of game to be played (e.g., open play or league play). The initialization process may be continued by one or more persons playing at the lane by entering their personal information into a lane score computing input device at the lane itself. For example, the user may enter their name (as well as the names of the other players), the players ages, whether any player requires special assistance (such as bumpers), and other related information. Additionally, as taught herein, the player can select one or more options for special effects to be presented during play. For example, the player can opt to turn off all special effects, select to have all special effects turned on, or select a specific combination of special effects to have presented during play.

Following initialization, the centralized management system may monitor 504 events occurring at that specific lane or lanes for any events to occur that are programmed to trigger a special effect. If the centralized management system determines 506 that no event has occurred (or no event has occurred that is programmed to trigger a special effect), the system can continue to monitor 504. However, if the centralized management system does determine 506 that an event has occurred, the system can further determine 508 which associated special effect is associated with that event. For example, if the event is a strike, the system may determine 308 that the lights at that lane are to flash, a sound effect is to be played, and a related image (e.g., an "X") is to be displayed on the monitor. Additionally, or optionally, the system may determine 310 a specific location for the special effect to occur. For example, for a common event such as a strike, the system may determine 510 that the special effect is to be displayed only at the lane where the event occurred. However, for an event that rarely occurs (such as a perfect game), the system may determine 510 that the special effect should be displayed throughout the entire bowling center.

After determining 508 what special effect to present, as well as determining 510 where to present the special effect, the special effect is presented 512. As described above, the special effect may include one or more of video projections, flat panel video displays, LED video displays, multi-colored lighting, ultra-violet lighting, laser effects, audio effects, and/or fog/haze/CO2/snow/bubble/confetti effects and other similar special effects.

It should be noted that the process as shown in FIG. 5, and described above, is directed toward a single set of players at a particular bowling lane by way of example only. The techniques as described herein are to be understood as applicable to all aspects of the bowling center, as described above in greater detail. As such, the centralized management system is configured to monitor and respond to any and (potentially) all events that occur within the bowling center.

Figure 6:
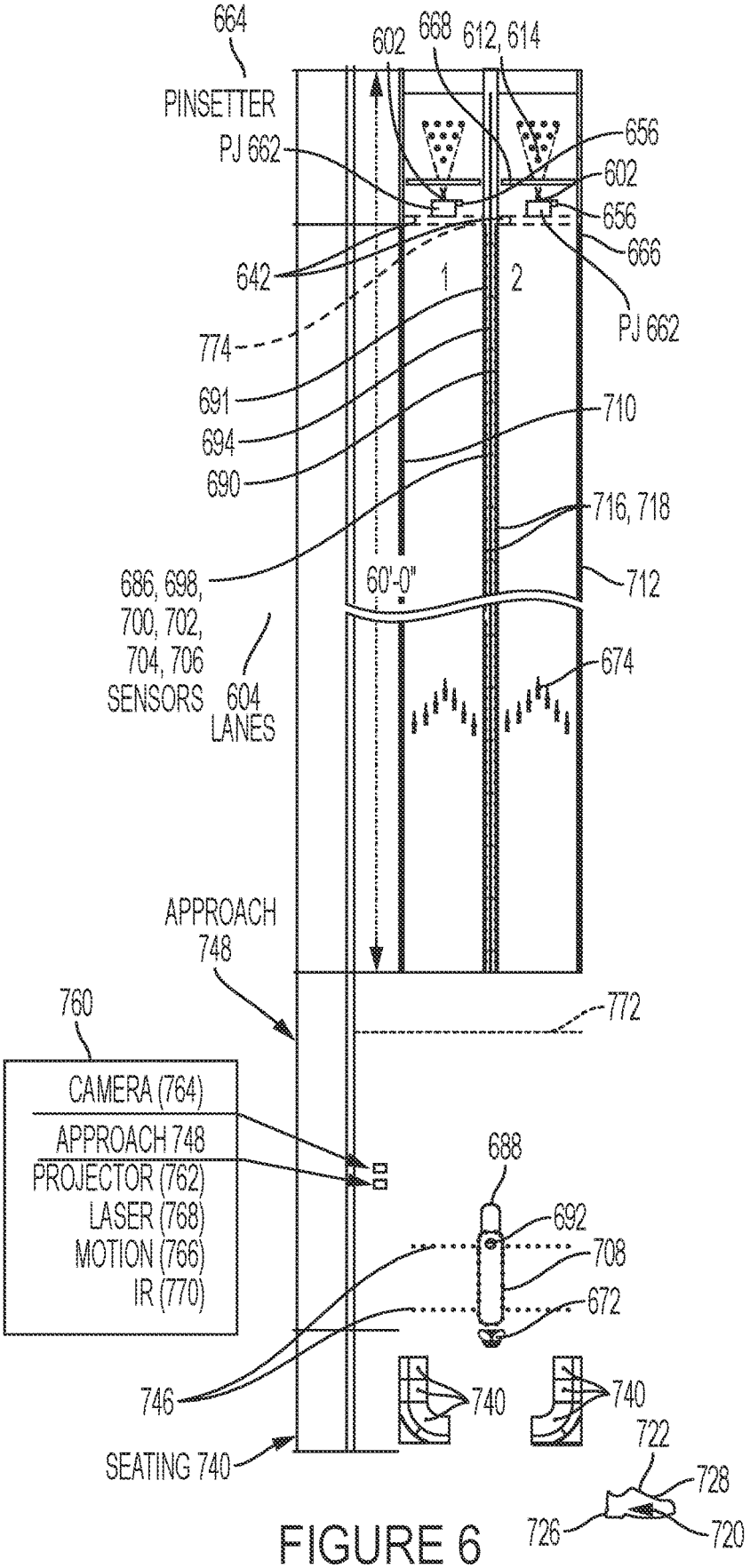
FIG. 6 shows a representative bowling center according to an embodiment.
Figure 7A:
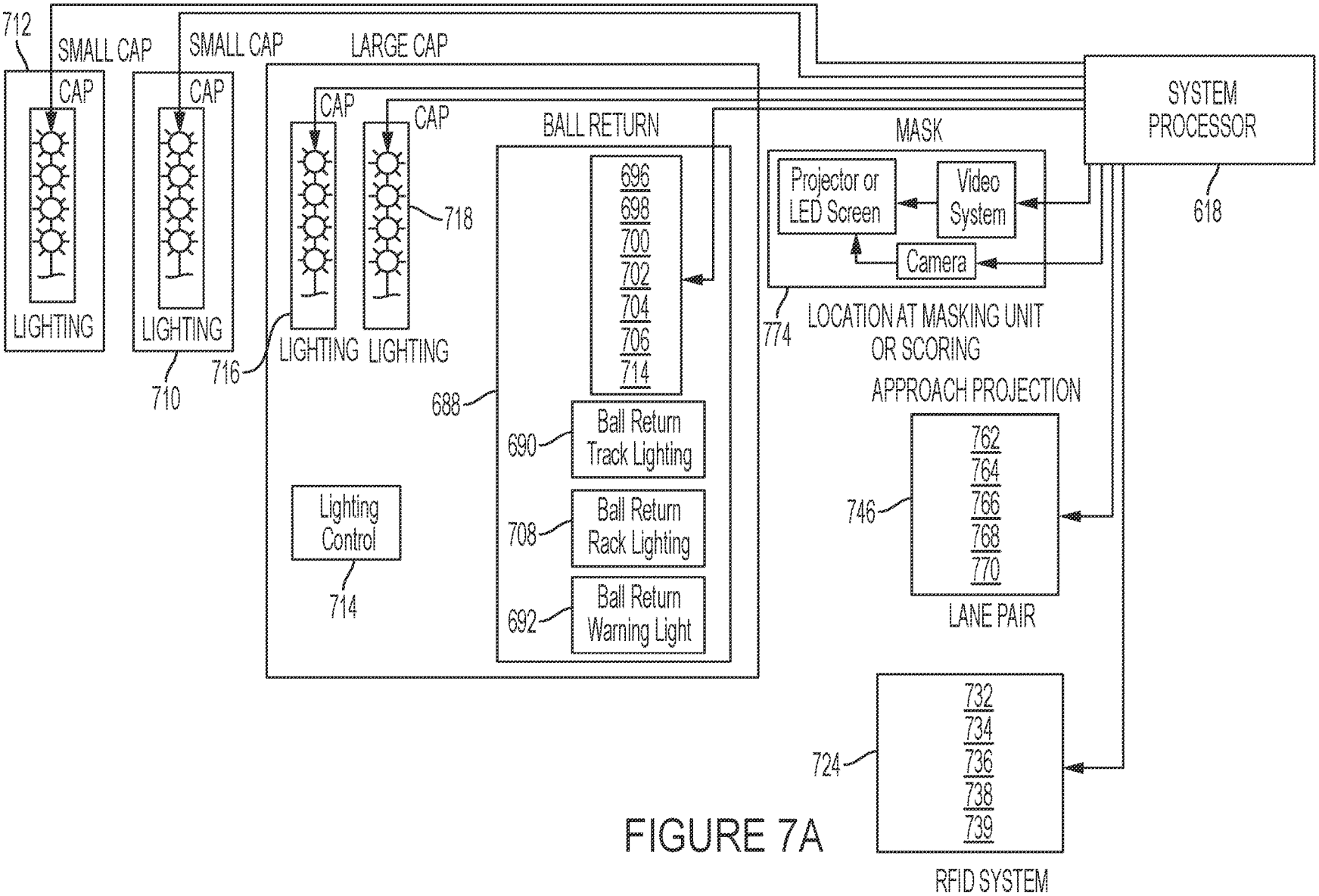
FIGS. 7A-7C show a line diagram of the individual components of the bowling center in FIG. 6.
Figure 7B:
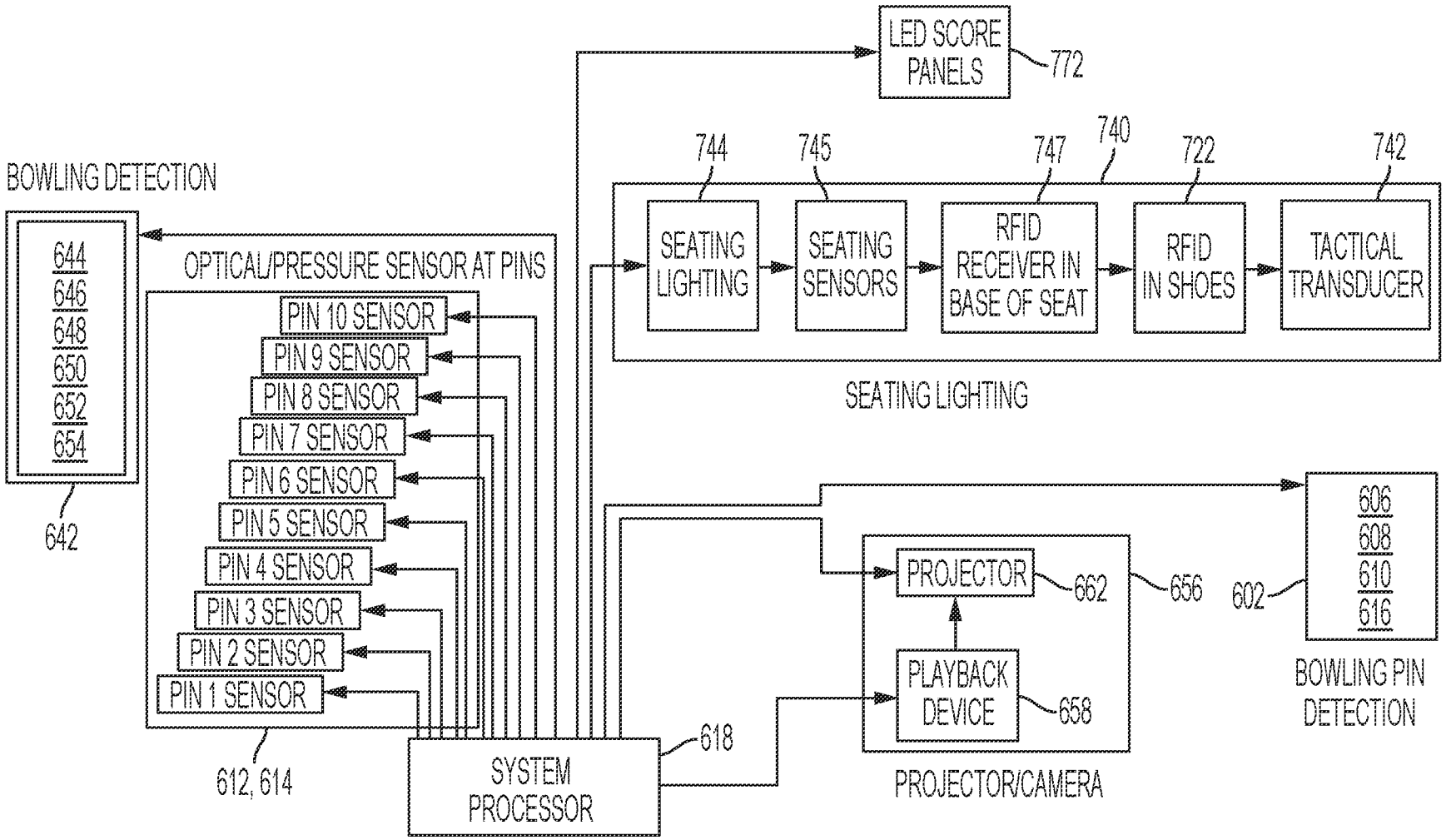
Figure 7C:
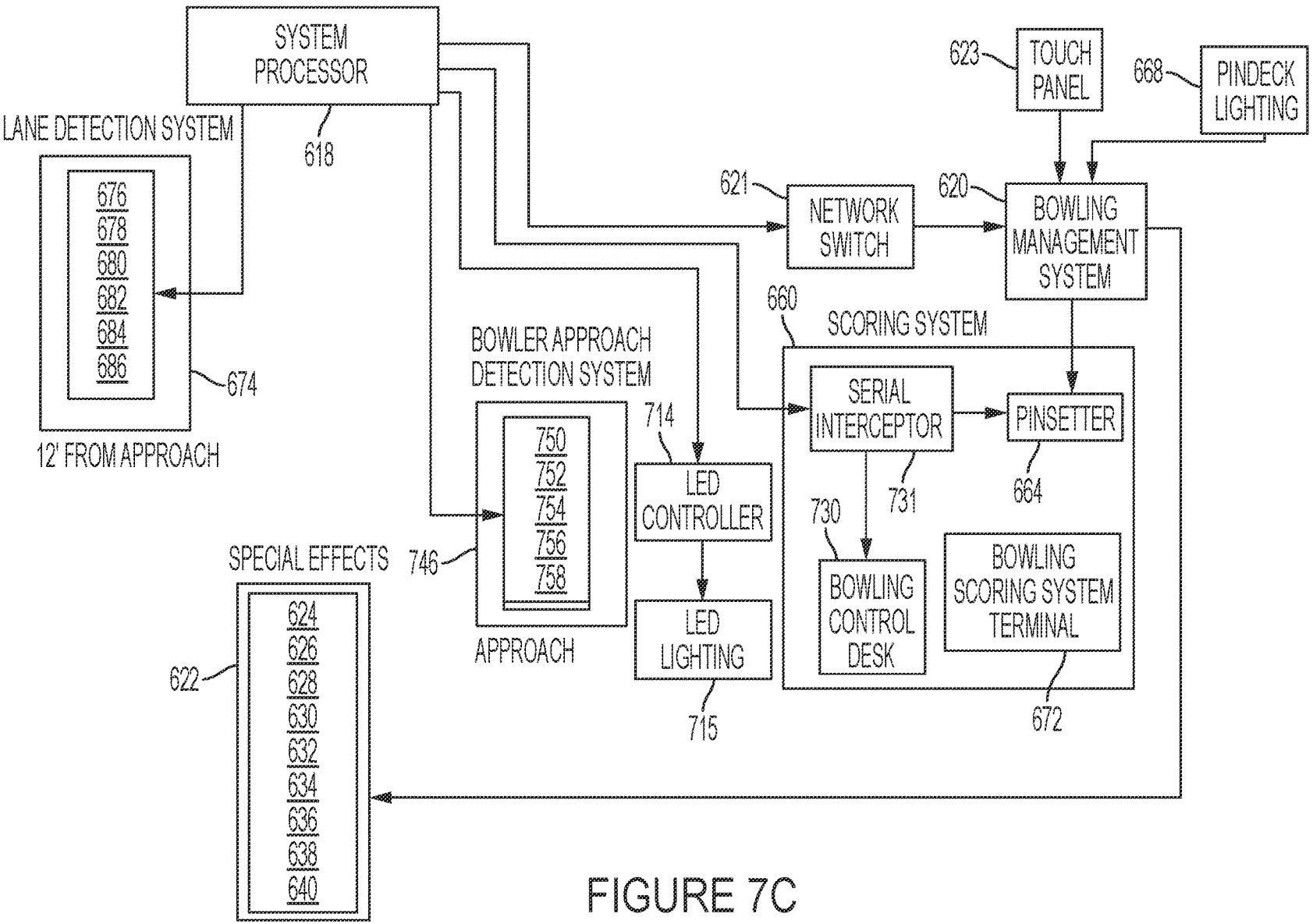

FIG. 6 shows another representative bowling center in accordance with aspects of the present disclosure, and FIGS. 7A-7C show a line diagram of the individual components of the bowling center in FIG. 6. More specifically, FIGS. 6 and 7A-7C show several components and interactions amongst the components in the bowling center. For example, FIGS. 6 and 7A-7C show a bowling pin detection system 602 and a bowling shot detection system 642.

A bowling pin detection system 602 is used to detect which bowling pins are still standing before and after a bowling ball is rolled down a bowling lane 604. The bowling pin detection system 602 can use camera tracking 606, motion detection 608, laser detection 610, pressure sensors 612, or optical sensors 614 under the pins, infrared 616 or similar devices with a connection to a system processor 618 to determine which bowling pins are still standing. According to various embodiments, the system processor 618 then uses this information to determine the bowling shot or the combination of the pins standing.

Based on this information, the system processor 618 executes programming instructions to communicate with a bowling management system 620 via, for example, a network switch 621. According to various embodiments, the bowling management system 620 then triggers one or more special effects 622, playback devices 624, video effects 626, audio effects 628, fog effects 630, haze effects 632, carbon dioxide effects 634, snow effects 636, bubble effects 638, confetti effects 640, and/or other suitable effects. According to various embodiments, the bowling management system 620 may be coupled to one or more user interfaces such as, for example, a keyboard, touch panel 623, and/or other suitable user interface.

According to various embodiments, a bowling shot detection system 642 is used to determine if a bowling shot has been taken or a bowling ball has been rolled down a bowling lane 604. A motion detector 644, camera 646, laser 648, infrared beam 650, pressure sensor 652, optical sensor 654, and/or similar device(s) are connected to the system processor 618. According to various embodiments, when the sensor(s) are triggered, the system processor 618 communicates with the bowling management system 620. The bowling management system 620 records the actions taken by the system processor 618. According to various embodiments, if additional actions are required, the bowling management system 620 triggers one or more special effects (300), playback devices 624, video effects 626, audio effects 628, fog effects 630, haze effects 632, carbon dioxide effects 634, snow effects 636, bubble effects 638, confetti effects 640, and/or other suitable effects.

According to various embodiments, a video pin deck projection mapping system 656 is implemented. The video pin deck projection mapping system 656 is a video system that uses bowling pins as the projection surfaces. According to various embodiments, the video pin deck projection mapping system 656 uses a camera to scan the bowling pins for the size and shape of each pin. According to various embodiments, this is done for all 1024 bowling shot combinations of a complete bowling game. Then, color, video graphics, effects, themed content, advertising, instructions, lane identification, and/or other types of content (e.g., video content) are added to each of the scanned images of the bowling pins, using a computing device.

Since video content is digital, there is virtually no limitation to what images can be displayed on the bowling pins. According to various embodiments, the video content is loaded onto a playback device 658. The playback device 658 can be a variety of types of devices. These can include, USB memory sticks, DVD players, Blu-ray players, media server, cable/satellite television receivers, computer, and/or other types of playback devices. The playback device 658 is connected to the system processor 618 to control which video content the playback device 658 is to play back. According to various embodiments, the system processor 618 is connected to either a bowling scoring system 660 (e.g., scoring system 200 as shown in FIGS. 2 and 4) and to pin detection systems 602 and to the bowling shot detection system 642.

According to various embodiments, the bowling scoring system 660, the pin detection system 602, and the bowling shot detection system 642 provide information about pin combinations and/or bowling shots. This information is used to choose the video content that is to be selected and played by the playback device 658. The playback device outputs the video signal to a video projector 662 used to illuminate the bowling pins. The video projector 662 is mounted on a bowling machine/pinsetter/pinspotter 664 or masking unit 666 or projector mount.

According to various embodiments, the video pin projection mapping system 656 can operate with various types of resolution. These include, for example, standard definition and high definition, ultra-high definition 4*k* or 8*k*, XGA, WXGA and WUXGA, and/or other types of resolution presently available or yet to be determined. Various aspect ratios can be used in conjunction with the video projector 662. These include, for example, widescreen 16:9 aspect ratio, 4:3 aspect ratio, and/or other aspect ratios. The video projector 662 provides versatility so that various images, videos, and/or colors can be projection mapped onto the bowling pins.

According to various embodiments, manually focused and/or motorized focus video projectors 662 may be used. According to various embodiments, when manually focused video projectors 662 are used, the focus is calibrated to all ten pins with the main focus being on the number five bowling pin. This pin is located in the center of the ten-pin setup for a full frame of bowling pins. According to various embodiments, when a motorized focus video projector 662 is used, the focus can be automated to work with the system control processor 618 and the bowling management system 620. According to various embodiments, each of the video playback files includes an optimal focus setting. The files are loaded with the focus parameters and sent to the video projector 662. Therefore, each video image is at its optimal focus.

According to various embodiments, video projector 662 brightness is measured in lumens. The brightness needed to light the bowling pins varies depending on the ambient lighting of the location. According to various embodiments, a minimum of 500 lumens is implemented for an acceptable video quality. It is noted, however, that other levels of lumens may be implemented. The higher the number of lumens of the projector, the brighter the projected image. The white surface of each of the bowling pins are an ideal surface to project on to. All ten pins are used as a projection surface for the duration of all of the frames within each of the bowling games played.

Video content can be displayed on one or multiple lanes at one time or in any combination. Using video content on multiple pinsetters 664 at one time would create a "show" over multiple bowling lanes 604. This can include interactive effects with games over multiple lanes, where a player can bowl, causing effects and graphics to move to adjacent lanes.

The video pin projection mapping systems 656 are generally used with the pin deck light(s) 668 being off. This is done to further enhance the quality and intensity of the video images. Although it is also noted that, according to various embodiments, the pin deck light fixtures 668 could be used in conjunction with the video pin projection mapping system 656. The pin deck lighting system 668 is another feature that is operated and control by the bowling management system 620. Additional interactive effects and programming can be included.

The video pin projection mapping system 656 can also provide targets on the bowling pins to show where to optimally strike the pins to successfully complete the bowling frame. These targets are great training tools for bowlers of all levels and abilities. The video pin projection mapping system 656 can also be used for lane identification. This could be done by projecting the lane number or graphic on to the bowling pins to identify the bowling lane 604. Since the video pin projection mapping system 656 can be connected to the bowling scoring system 660, each of the players scores can be projected on the pins at the start of each frame.

According to various embodiments, the video pin projection mapping system 656 can be used to play additional bowling games with the projection of a specific colored or graphic on a pin or combination of pins. When the colored or graphic pin(s) are knocked down by the player bowling, the system processor 618 can notify the outcome of the shot to the bowling management system 620. Then, the bowling management system 620 triggers one or more special effects 622, playback devices 624, video effects 626, audio effects 628, fog effects 630, haze effects 632, carbon dioxide effects 634, snow effects 636, bubble effects 638, confetti effects 640, one or more other effects, and/or the scoring system 660. According to various embodiments, the scoring system 660 then awards the result of the action by changing the score or awarding a prize to the player. These types of games could be played by one or multiple lanes at a time. In addition, the bowling scoring system main control 670 can be used to set-up the bowling games, set colors, graphics, themes and prizes with the systems interconnection with the bowling management system 620. The games, themes, effects and graphics could be selected by the players at each lane using the bowling scoring system terminal 672 at each lane.

Additionally, the video pin projection mapping system 656 can be used to provide video projections on the pinsetter sweep on traditional ten pin pinsetters and on pinsetter ball blockers/sweeps on string pin pinsetters. The video pin projection mapping system 656 can be linked and synchronized to an audio track and/or audio systems 628. The synchronizations between all of these systems are by the bowling management system 620.

According to various embodiments, a lane detection system 674 is used to track the bowling ball down the bowling lane 604 and provide information about the bowling balls trajectory to the system processor 618. This is done by using, for example, motion detectors 676, cameras 678, lasers 680, pressure sensors 682, optical sensors 684, infrared 686, and/or similar devices with a connection to the system processor 618. When the sensor(s) are triggered, the system processor 618 communicates to the bowling management system 620 to deploy one or more special effects 622, playback devices 624, video effects 626, audio effects 628, fog effects 630, haze effects 632, carbon dioxide effects 634, snow effects 636, bubble effects 638, confetti effects 640, and/or other effects. The system processor 618 is connected to the bowling management system 620 and will communicate the actions and triggers executed. The bowling management system 620 can provide additional special effects 622 to any or all other bowling lanes 604 based on the bowling shots taken. According to various embodiments, the synchronizations between this system are performed by the bowling management system 620.

According to various embodiments, a ball return effects system 688 provides an active lighting effect 690 and warning light 692 with the bowling balls being returned from the pinsetter 664 back to the ball return of the ball return effects system 688 for each lane. According to various embodiments, the warning light 692 is positioned around the ball return opening at the ball return of the ball return effects system 688. This would warn bowlers that a ball was returning to the ball rack and to keep hands clear to prevent possible injury. According to various embodiments, the ball return effects system 688 can be used with below-lanes or above-lanes ball returns.

For below-lanes ball returns, the ball return cover boards or capping may be replaced with clear or translucent covers boards 694. Several types of sensors can be used to track the bowling balls. These include, motion 696, camera 698, laser 700, infrared sensors 702, pressure sensors 704, optical sensors 706, and/or other sensors. According to various embodiments, the sensors are installed into the ball return effects system 688 to track the bowling ball from the pinsetter 664 back to the ball return. According to various embodiments, LED lighting is installed into the ball return track 691, providing an active lighting effect 690 at the return track 691, to the opening of the bowl return, to the around the ball return (ball return rack lighting 708) and to a division cap (710 & 712) on the other side or the bowling lane 604. These and other lighting systems 715 are connected to a lighting controller 714. According to various embodiments, the lighting controller 714 and ball return effects system 688 are connected to the system processor 618. According to various embodiments, when the ball return effects system 688 is triggered by the returning bowling ball, the system processor 618 communicates to the lighting system controller 714 to illuminate the lighting and track the bowling ball as it returns to the ball return. This provides additional visual effects. Additionally, one or more special effects 622, playback devices 624, video effects 626, audio effects 628, fog effects 630, haze effects 632, carbon dioxide effects 634, snow effects 636, bubble effects 638, confetti effects 640, and/or other effects can be triggered by the bowling management system 620. According to various embodiments, the system processor 618 is connected to a bowling management system 620 and communicates the actions and triggers executed.

According to various embodiments, the ball return effects system 688 can be used with the scoring system 660. According to various embodiments, when each player is set-up in the scoring system 660, they are assigned a specific color. When it is the players turn to bowl, the scoring system 660 triggers the bowling management system 620 to change the color of the ball return and cap lighting system (716 & 718) to that player's corresponding color.

According to various embodiments, for above-lanes ball returns, the system would be similar, but the cover boards or capping would not be needed. The system would be operated the same way as the below-lane ball returns.

According to various embodiments, the system includes one or more pairs of interactive bowling shoes 720. According to various embodiments, the interactive bowling shoes 720 include a Radio Frequency Identification (RFID) tag 722 installed onto or into one or both of the pair of bowling shoes 720. The RFID tag 722 uses radio waves to identify people or objects. A radio frequency wireless device 724 reads the information contained in the wireless RFID tag 722 from a distance without making physical contact. According to various embodiments, the RFID tag 722 in the bowling shoe 720 can be read and assigned to each player when the bowling shoes 720 are rented from the facility. Other types of RFID tags could be used for customers that did not purchase rental bowling shoes 720. These include, for example, wrist bands, lanyards, wearable RFID tags, and/or other types of tags. It is also noted that other types of tagging technology may be implemented.

According to various embodiments, RFID readers 724 with, for example, communication antennas or other communication hardware, can be installed strategically into the bowling facility. The RFID readers 724 can internally track each player's location within the facility. The RFID reader system 724 can be connected to the system processor 618. The system processor 618 can be connected to, and trigger, the bowling management system 620. The bowling management system 620 can trigger one or more special effects 622, playback devices 624, video effects 626, audio effects 628, fog effects 630, haze effects 632, carbon dioxide effects 634, snow effects 636, bubble effects 638, confetti effects 640, and/or other effects based on the player's location or event.

According to various embodiments, the bowling scoring system 660 is connected to the bowling management system 620, enable the scoring system 660 to indicate to the bowling management system 620 that it is a player's turn to bowl by triggering one or more special effects 622, playback devices 624, video effects 626, audio effects 628, fog effects 630, haze effects 632, carbon dioxide effects 634, snow effects 636, bubble effects 638, confetti effects 640, and/or other effects. According to various embodiments, battery 726 powered effects can be included within, or externally on, the bowling shoe(s) 720. These effects can include, for example, LED lighting and vibration devices 728.

According to various embodiments, the tracking of the bowling shoes 720 can provide warnings to a bowling control desk 730 (via, e.g., a serial interceptor 731) or management that the bowling shoes 720 were or are being removed from the facility. It could also prompt an email to management or to the customer that rented the bowling shoes 720 were or are missing. Then, the management can contact the customer about the missing shoe(s) 720 and possibly prevent the loss.

Additional uses of the bowling shoe 720 with the RFID tag 722 installed in the shoe(s) 720 can, for example, include, but are not limited to:

- opening an equipment locker with an RFID lock 732;
- accessing control 734 to attractions admittance (e.g., mini golf, laser tag, ropes courses, trampolines, go karts, dark rides, etc.);
- providing arcade games 736 use by RFID reader 724;
- providing information to point of sales systems (POS) 738 for food & beverage purchases; and
- providing information as to the status of the shoe(s) 720 and whether the shoe(s) 720 has been sanitized 739 by, for example, staff.

According to various embodiments, the system includes interactive bowling seating 740. According to various embodiments, the interactive bowling seating 740 can include tactical transducers 742 mounted underneath the base of each seat 747. The tactical transducers 742 are connected to an audio system 628. According to various embodiments, when specific tones are played through the audio system 628, the tactical transducers 742 cause the seat to vibrate. According to various embodiments, the bowling management system 620 can control and trigger the interactive bowling seating 740 to vibrate at specific times. This system could work as a standalone effect or in any combination with other special effects 622 controlled by the bowling management system 620. According to various embodiments, the seating 740 includes one or more sensors 745 for sensing one or more players.

According to various embodiments, having the bowling scoring system 660 connected to the bowling management system 620, the triggers could be tied to bowling shots and provide game interaction. For example, a player could bowl a strike which causes the tactical transducers 742 to output a sound and, in turn, vibrate the interactive bowling seating 740. The effect can be used with all other special effects triggers from the bowling management system 620 with one or more special effects 622, playback devices 624, video effects 626, audio effects 628, fog effects 630, haze effects 632, carbon dioxide effects 634, snow effects 636, bubble effects 638, confetti effects 640, and/or other effects. According to various embodiments, messages can be sent to bowler's mobile devices.

According to various embodiments, interconnecting the scoring system 660 with the Radio Frequency Identification (RFID) reader system 724, the interactive bowling seating system 740, and/or the bowling management system 620, the combination of systems could alert the player when it is their turn to bowl. According to various embodiments, the scoring system 660 could identify which player's turn it was, the RFID reader system 724 tracks the player inside the bowling center and determines if the player is seated on an interactive bowling seat 740. The bowling management system 620 would vibrate the seat the player is sitting on with the tactical transducer 742 and trigger the lighting effect within a seat 744.

According to various embodiments, the system includes a bowlers approach detection system 746 that is used to track a bowler's position on the bowlers' approach 748. This system 746 incorporates tracking a position and location of the player's feet. This can be done by using motion detectors 750, cameras 752, lasers 754, pressure sensors 756, optical sensors 758, and/or similar sensor(s) connected to the system processor 618. According to various embodiments, when the sensor(s) are triggered, the system processor 618 communicates to the bowling management system 620, triggering one or more special effects 622, playback devices 624, video effects 626, audio effects 628, fog effects 630, haze effects 632, carbon dioxide effects 634, snow effects 636, bubble effects 638, confetti effects 640, and/or other effects. This includes the video mapping pin projections system 656 on to the bowling pins of each lane 604. According to various embodiments, the system processor 618 is connected to the bowling management system 620 and will communicate the actions and triggers executed. The bowling management system 620 can provide additional effects to any or all other bowling lanes 604 based on the bowling shots taken. According to various embodiments, all synchronizations between the bowlers approach detection system 746 are by the bowling management system 620.

According to various embodiments, additional effects on the approach 748 can be done by connecting the approach detection system 746 with an approach projection mapping system 760 mounted above the bowlers' approach 748. According to various embodiments, the approach projection mapping system 760 projects color, video graphics, advertising, instructions, lane identification, scoring, television, and/or other types of content (e.g., video content) onto the bowlers' approach 748 and surrounding areas. According to various embodiments, video projectors 762 can be mounted above the bowlers' approach 748 with a connection to the system processor 618. According to various embodiments, the system processor 618 incudes connections to one or more tracking devices cameras 764, motion sensors 766, lasers 768, infrared sensors 770, one or more other sensor(s), and/or the approach detection system 746 to track the players in the area. According to various embodiments, the system processor 618 uses this information to determine where the players are standing on the approach 748. According to various embodiments, the system processor 618 is connected to the bowling management system 620. The bowling management system 620 triggers which video images should be projected onto the approach 748. According to various embodiments, the bowling management system 620 can then trigger one or more additional special effects 622, playback devices 624, video effects 626, audio effects 628, fog effects 630, haze effects 632, carbon dioxide effects 634, snow effects 636, bubble effects 638, confetti effects 640, and/or other effects. The approach projection mapping system 760 could cover the entire approach 748 in the bowling center or just parts of it. This includes video projections on the ball returns and bowling balls in the ball returns. Additionally, a windowing video processor can be added to the approach projection system 760 to provide windows or picture in picture displays with any type of video content.

According to various embodiments, direct view LED panels 772 can be installed in place of the traditional LCD video panels used for scoring. These LED panels 772 could be, for example, ceiling mounted with one contiguous screen above the bowlers' approach 748. The LED panels can display video graphics, advertising, instructions, lane identification, scoring, television, and all types of content. The size of the video content can be for a specific bowling lane or any combination of bowling lanes 604. The direct view LED panels 772 can also be used as one continuous image over all of the LED panels 772.

According to various embodiments, the system processor 618 and a widowing processor can be used to provide system programming and content. The system processor 618 can include programming instructions to communicate with the bowling management system 620. The bowling management system 620 could then trigger one or more additional special effects 622, playback devices 624, video effects 626, audio effects 628, fog effects 630, haze effects 632, carbon dioxide effects 634, snow effects 636, bubble effects 638, confetti effects 640, and/or other effects.

According to various embodiments, with the interconnection with the bowling management system 620, simultaneously video content on any or all of the following displays, a video masking system 774, the video pin deck projection mapping systems 656, the bowlers approach projection mapping system 746, and/or any LED video display panels 772 can be displayed at one time.

Additional Examples and Embodiments of the Disclosure

Referring again to FIGS. 1-4, in operation, a video signal can be delivered to the video projector system 10 such as a movie, TV channel, media server/player, internet device (Apple TV/Roku, etc.), PC, game console, DVD player, Blu-Ray player, camera system, smart phone, tablet PC, digital signage player or device, scoring system 200 with any of these video sources can be processed by computerized special effects equipment and instructed by the centralized management system 300. The video source can be managed by a computerized special effects equipment system and the centralized management system 300 so that each video projector or multiple projectors can display video and/or other effects in accordance with aspects of the present disclosure.

For example, each video projector can display a different portion of the original video signal so that the combination of the video projectors generates a larger image. This is referred to as a matrix video wall (i.e., a 3×3 display matrix can display a single video into an area 9 times larger than the single projector). This can be done by hard or soft edge blending of the video projector(s) output. Inside a bowling center this technique can be used on the video mask to display a single and very large picture, video or any of the above video sources across all lanes in the bowling center, or an advertising banner moving/scrolling across all lanes in a bowling center (for example from lanes 1 to lane 30). A typical matrix video wall on a masking unit would be a 1×15 wall for the example 30 lanes. Any combination and sizes of matrix video walls are possible. Alternatively, one or more video screens may be used to provide a video wall for the masking unit. For example, a 3×3 matrix of flat panel displays may be used to create a video wall in addition to or as an alternative to the video projectors as described above.

Further, in operation, the video projection system 10 can be an array of video projectors interspersed throughout the bowling center, e.g., over the bowling lanes in FIG. 4. This array of video projectors can use a camera device (or other detection device) (e.g., tracking camera 415) to identify people and objects that cross onto the video projection surface area and enable the system to react and change the image being displayed by the projectors according to the motion of the person or object/objects in the video projection display area. In embodiments, the array of video projectors is managed by the centralized management system 300. Many kinds of lighting fixtures can also be controlled by the centralized management system 300 to create lighting effects and "mood" within the bowling center. These lighting fixtures can be multi-color lighting fixtures, e.g., LED lighting, above the bowling lanes 55, approach area 65, pin deck 420, masking unit 45, architectural lighting 85, wall or any surface 25 in which the multi-color lighting fixtures, e.g., LED lighting, project lighting effects onto the lane surface 200*a* and 200*b*, approach 35, pins 45, masking unit 55, architectural lighting 85, wall or any surface 25 in the bowling center changing the color appearance of the surface and creating a nice visual effect on the surface in the bowling center, any of which are managed by the centralized management system 300.

Accordingly, in one or more embodiments, the present disclosure provides interaction of the projection and lighting effect systems used in bowling centers with the bowling scoring and management system 100 to allow the video content, audio and lighting content delivered by these systems to respond to many different events, including scoring games and events occurring on the bowling lane (and that are known and managed by the scoring system 200, tracking system 415, proximity sensors 100, pressure sensors 95). The result is that the bowling scoring and management system 100 can drive and also affect the video content delivered by the video projector system 10 (either with or without a camera/sensor/detection device for interactivity with the bowler and/or bowling ball) and/or video camera 40, architectural lighting 85, audio 75, lighting 30 systems in the bowling center.

This integration and interaction can be achieved in many different ways because video, audio and lighting systems can be provided with computerized control and standardized interfaces (i.e., the computerized system controlling the video projector is a computer and thus the computer software running on it can get input by the bowling scoring system through Ethernet). For example, the effects lighting control system may be a DMX controller that can be set up to interact with the bowling scoring and management system through a serial, infrared, ASCII, Hex, contact closure or Ethernet connection.

Examples of the interaction that are achieved by linking these devices to the bowling scoring and management systems include, amongst others and in no particular order of importance, the following features.

I. Extend any graphic, environment, or scoring data available within the bowling and scoring management system 100 to the bowling lane, approach and masking unit or other surfaces.

II. Allow bowlers to use the scoring consoles or a mobile device to choose content to be projected onto the bowling lane, approach, and masking unit or other surfaces. For example, there can be games within the scoring system that allow users to choose images or animations and project them on the lane surface (i.e. the bowling lane can look like grass, ice, a road, plasma, a night sky with stars, etc.).

III. Allow bowlers to create their own content through the scoring consoles or a mobile device and project it onto the lane (e.g., by using different patterns, brushes and stamps, etc. available kids can create their own picture on the lane, as if they were painting the lane).

IV. Project a welcome screen (or any type of digital content) onto the approach to welcome bowlers just arriving to the lane or other surfaces.

V. Any graphic, environment, or scoring data available within the bowling and scoring management system can be sent to the bowling lane, approach area and masking unit or other surfaces.

VI. Integrate with the redemption device 500 to deliver virtual tickets, free/discounted bowling games, food and beverage coupons, arcade tokens and/or tokens as images projected onto the lane surface.

VII. Display any advertising messages and images originating from the scoring and management system onto the bowling lane, approach, masking unit and/or to any/all video display.

VIII. Project a topographic image representing the oil pattern onto the bowling lane, approach or surface.

IX. Project a safety warning message or image onto the lane to warn bowlers not to cross the foul line and respect the bowling center rules.

X. Project a foul video clip animation as soon as the scoring system detects that the foul detector unit has been tripped by someone crossing the foul line.

XI. Extend any game managed by the scoring system to the bowling center surfaces, e.g., lane surface, so the competition between lanes can be visualized on the lane surface, through a histogram starting from the end of the lane and growing towards the approach area. At every ball thrown the corresponding histogram bar grows. The first lane whose bar reaches the approach area wins.

XII. Extend any game managed by the scoring system to the bowling center surfaces, e.g., lane surface, displaying the scene on the lane surface, all across the bowling center. (i.e., a train image enters on lane 1 and moves across all adjacent lanes, going back and forth several times, getting closer to the approach with every time. When the train stops, all doors open and from one of the train cars a "You Won!" banner is displayed).

XIII. Display scoring information directly on the lane or other bowling center surfaces, in addition to or instead of those shown on the monitors. For example:

i. Display nicknames, pictures and other data about the bowler on the lane, approach and/or masking unit;

ii. Display the score made with the latest ball thrown (i.e. "7" or "strike") onto the lane, approach and/or masking unit;

iii. Celebrate remarkable scoring achievements with specific animations on the lane, approach and/or masking unit (i.e. "three strikes in a row");

iv. Show bowler standings and recap data on the lanes and/or masking unit; and/or v. Display an histogram on the lane, one bar per bowler with name and current score, to show intuitively how the match is proceeding and who's leading and following.

XIV. Allow bowlers to use the scoring consoles to create content images (avatar) that will follow the ball path down the lane.

XV. Integrate with a sound system to create specific sounds that react to the ball motion and/or graphical images. For example, a gutter ball is accompanied by a sound effect.

XVI. Integrate a spare finder projected onto the bowling lane to show bowlers where to throw the ball using arrows on the lane (extension of the spare finder in the scoring system).

XVII. Project the ball path onto the lane to help bowlers learn and improve their performance (e.g., use a different color for first and second ball, colored stripes displayed at specific positions on the lane, with the ball that has to pass in between).

XVIII. Keep the history of the ball paths and project them onto the lane to show how consistent the bowler is in their bowling patterns. Additionally, such a feature can be used for training purposes to improve a bowler's skills.

XIX. Improve safety in the bowling center by using the system to identify everything that does not look like a bowling ball that crosses the foul line onto the lane and warn bowlers by projecting visual and sonic alerts and stopping the pinspotting machine is the shape gets too close.

XX. Improve security and safety in the center by being able to view, monitor and operate the security camera system 90 by the central management system 300.

XXI. Improve the security and life safety by including a panic button 105 on the central management system 300 user interfaces or separate concealed button near interfaces to automatically alert authorities when there are potential issues or trouble in the bowling center.

XXII. Reduce the need for additional lighting, security system, HVAC controls by integrating them into the central management system 300.

XXIII Reduce the energy consumption of the entire bowling center by integrating and scheduling the systems on/off times.

XXIV. Use of LED lighting in and on equipment and surfaces with integrated DMX/Art-Net or similar control with either wired or wireless connections. These include, but are not limited to, bowling balls, bowling pins, furniture, ball returns, pinspotters/pinsetters, masking units, bowling shoes, clothing, or other surfaces, fixtures and items within a bowling center.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A system for providing an interactive bowling experience, the system comprising:

a management system, including:

a memory and a processing device, and a non-transitory computer readable medium in communication with the processing device, the non-transitory computer readable medium storing one or more programming instructions that, when executed, cause the processing device to:

store a listing of one or more trigger events as well as any special effects associated with each of the one or more trigger events, monitor activity within a bowling center for detection of an occurrence of a trigger event, determine a location of a user, wherein the location of the user is a seat within the bowling center;

determine whether the trigger event has occurred and, if the trigger event is determined to have occurred:

determine one or more special effects associated with the trigger event, wherein the one or more special effects include:

activating one or more lighting or vibratory effects at the seat within the bowling center at which the user is located; and provide instructions to one or more special effect components to perform the one or more special effects associated with the trigger event.

2. The system of claim 1, wherein the one or more trigger events comprise at least one of a strike or a sequence of strikes, gutter balls, a high score, a perfect score, a score over a particular value, and a start of a turn of the user.

3. The system of claim 1, wherein the one or more special effect components comprise at least one of a video display, a video projector, an audio system, a tactile feedback system and an architectural lighting system.

4. The system of claim 1, wherein the one or more special effects comprise at least one of video projection effects, multi-colored lighting effects, ultra-violet lighting effects, laser effects, audio effects, fog effects, haze effects, carbon dioxide effects, snow effects, bubble effects and confetti effects.

5. The system of claim 1, wherein the one or more programming instructions further comprise one or more programming instructions configured to cause the management system to receive, from at least one input device, initialization information related to operation of the bowling center.

6. The system of claim 5, wherein the initialization information comprises at least one of a type of game to be played, one or more player names, one or more player ages, and a selection of one or more special effects that can be triggered during play.

7. The system of claim 1, wherein the occurrence of the trigger event is detected by at least one of a scoring system, a security system, one or more cameras, one or more proximity sensors, one or more pressure sensors and one or more motion sensors.

8. The system of claim 1, further comprising one or more tracking tags configured to be worn by the user.

9. The system of claim 8, further comprising one or more shoes, wherein the one or more tracking tags are housed within the one or more shoes.

10. The system of claim 9, wherein the programming instructions are further configured to cause the processing device to determine if the one or more shoes have been removed from the bowling center.

11. The system of claim 10, wherein the programming instructions are further configured to cause the processing device to generate a notification when it has been determined that the one or more shoes have been removed from the bowling center.

12. A method for providing an interactive bowling experience, the method comprising:

storing, by a management system, a listing of one or more trigger events as well as any special effects associated with each of the one or more trigger events;

receiving, by the management system, from at least one input device, initialization information related to operation of a bowling center;

receiving, by the management system, event occurrence information from one or more detection devices;

determining a location of a user to be a seat within the bowling center;

monitoring, by the management system, the event occurrence information for occurrence of a trigger event having at least one associated special effect;

determining, by the management system, whether the trigger event having the at least one associated special effect has occurred; and in response to the trigger event having the at least one associated special effect occurring:

determining, by the management system, one or more special effects associated with the trigger event, wherein the one or more special effects include:

activating one or more lighting or vibratory effects at the seat within the bowling center at which the user is located; and providing, by the management system, instructions to one or more special effect components to perform the one or more special effects associated with the trigger event.

13. The method of claim 12, wherein the one or more trigger events comprise at least one of a strike or a sequence of strikes, gutter balls, a high score, a perfect score, a score over a particular value, and a start of a turn of the user.

14. The method of claim 12, further comprising determining the location of the user using one or more tracking tags configured to be worn by the user.

15. The method of claim 14, wherein the one or more tracking tags are housed within one or more shoes.

16. The method of claim 15, further comprising determining if the one or more shoes have been removed from the bowling center.

17. The method of claim 16, further comprising generating a notification when it has been determined that the one or more shoes have been removed from the bowling center.

18. A system for providing an interactive bowling experience, the system comprising:

a management system, including:

a memory and a processing device, and a non-transitory computer readable medium in communication with the processing device, the non-transitory computer readable medium storing one or more programming instructions that, when executed, cause the processing device to:

store a listing of one or more trigger events as well as any special effects associated with each trigger event, monitor activity within a bowling center for detection of an occurrence of at least one of the one or more trigger events, and in response to the occurrence of the at least one of the one or more trigger events:

provide instructions to one or more special effect components to, for at least one bowling pin:

scan an image of the at least one bowling pin;

add one or more graphics to the scanned image; and project the scanned image and the one or more added graphics on the at least one bowling pin.

19. The system of claim 18, wherein the programming instructions further cause the processing device to: in response to the occurrence of the one or more trigger events, activate a confetti event.

20. The system of claim 18, wherein the programming instructions further cause the processing device to: determine a location of a user using one or more tracking tags configured to be worn by the user.

* * * * *